US006024661A

United States Patent [19]

Guenther et al.

[11] Patent Number: 6,024,661

[45] Date of Patent: Feb. 15, 2000

[54] SWEAT-ABSORBING GAME BALL

[75] Inventors: Douglas G. Guenther, Carol Stream; Bradley Lee Gaff, Naperville, both of Ill.

[73] Assignee: Wilson Sporting Goods Co., Chicago, Ill.

[21] Appl. No.: 09/126,293

[22] Filed: Jul. 30, 1998

Related U.S. Application Data

[63] Continuation-in-part of application No. 08/959,741, Oct. 28, 1997, abandoned.

[51] Int. Cl.[7] ..... A63B 41/08

[52] U.S. Cl. ..... 473/605; 473/599

[58] Field of Search ..... 473/569, 573, 473/574, 594, 595, 596, 604–607, 300, 301, 302, 303, 549, 550, 568

[56] References Cited

U.S. PATENT DOCUMENTS

| | | | |
|---|---|---|---|
| 1,240,866 | 9/1917 | Miller . | |
| 1,402,682 | 1/1922 | Takashima . | |
| 1,614,853 | 1/1927 | Schwartz . | |
| 2,061,604 | 11/1936 | Winterbauer . | |
| 2,494,796 | 1/1950 | Brown . | |
| 2,494,806 | 1/1950 | Gibson . | |
| 2,761,684 | 9/1956 | Crowley . | |
| 2,819,753 | 1/1958 | Nogue . | |
| 2,896,949 | 7/1959 | Dunker . | |
| 3,119,618 | 1/1964 | Molitor . | |
| 3,219,347 | 11/1965 | Way . | |
| 3,506,265 | 4/1970 | Yugi . | |
| 3,606,326 | 9/1971 | Sparks | 473/300 |
| 3,863,923 | 2/1975 | Anderson . | |
| 4,187,134 | 2/1980 | Svub . | |
| 4,239,568 | 12/1980 | Takazawa . | |
| 4,284,275 | 8/1981 | Fletcher | 473/549 |
| 4,333,648 | 6/1982 | Aoyama . | |
| 4,347,280 | 8/1982 | Lau | 473/568 |
| 4,462,590 | 7/1984 | Mitchell . | |
| 4,660,831 | 4/1987 | Kralik . | |
| 5,040,795 | 8/1991 | Sonntag . | |
| 5,069,935 | 12/1991 | Walters . | |
| 5,181,717 | 1/1993 | Donntag | 473/605 |
| 5,310,178 | 5/1994 | Walker | 473/605 |
| 5,320,345 | 6/1994 | Lai . | |
| 5,413,331 | 5/1995 | Stillinger . | |
| 5,500,956 | 3/1996 | Schulkin . | |
| 5,518,800 | 5/1996 | Okawa . | |
| 5,542,662 | 8/1996 | Kouzai . | |
| 5,551,688 | 9/1996 | Miller . | |
| 5,636,835 | 6/1997 | Schindler . | |
| 5,669,838 | 9/1997 | Kennedy | 473/604 |
| 5,681,233 | 10/1997 | Guenther . | |

FOREIGN PATENT DOCUMENTS

| | | |
|---|---|---|
| 1097165 | 6/1995 | France . |
| 60-17871 | 5/1985 | Japan . |
| 62-44074 | 9/1987 | Japan . |
| 63-5518 | 2/1988 | Japan . |
| 64-20866 | 1/1989 | Japan . |

OTHER PUBLICATIONS

Encyclopedia of Polymer Science and Engineering (1987), pp. 677–697.

*Primary Examiner*—Steven Wong

[57] ABSTRACT

A sweat-absorbing game ball comprises an inflatable rubber bladder and a synthetic leather cover which surrounds the bladder. The synthetic leather cover includes a base fabric of polyurethane-impregnated nonwoven nylon fibers and an outer coating of wet-coagulated polyurethane. A pebbled surface configuration is molded into the outer surface of the cover, and the pebbled surface includes a plurality of outwardly projecting pebbles. Each pebble includes an outer surface and a side surface, and a plurality of small openings are formed in the polyurethane outer coating on the side surfaces of the pebbles.

4 Claims, 2 Drawing Sheets

SWEAT-ABSORBING GAME BALL

RELATED APPLICATION

This is a continuation-in-part of our copending patent application entitled "Sweat-Absorbing Game Ball," Ser. No. 08/959,741, filed Oct. 28, 1997 now abandoned.

BACKGROUND

This invention relates to game balls, and, more particularly, to an inflatable game ball having a synthetic leather cover which includes a polyurethane coating which is capable of absorbing sweat.

Game balls such as basketballs, soccer balls, and footballs conventionally include an inflatable bladder and a cover. The bladder may be reinforced with windings of nylon thread, polyester thread, etc. The cover is conventionally formed from panels of leather, synthetic leather, rubber, etc.

Synthetic leather covers have been well received as a substitute for more expensive leather covers. Synthetic covers are soft and easy to grip when dry. However, a synthetic leather cover becomes difficult to grip when the cover is wet with sweat. A genuine leather cover, particularly after breaking in, has small holes which absorb sweat so that the ball retains its grippability. On the other hand, a synthetic leather cover commonly includes a polyurethane coating which is relatively impervious to sweat.

Synthetic leather materials for basketballs and other game balls are available from Kuraray Co., Ltd. and Teijin Cordley Ltd., both of Japan. Basketballs using the Kuraray material are sold in the United States by Spalding under the name ZK 1000 Composite. Basketballs using the Teijin material are sold in the United States by Wilson under the names Jet Evolution and MP 5000.

The Kuraray material is described in Japanese Patent Publication Nos. 60-17871, 62-44074, 63-5518, and 64-20866. As described in those publications, a mat of fibers is formed from small denier or small diameter fibers which are made from two different polymers, e.g., polyethylene and nylon. The mat is impregnated with a solution of polyurethane in dimethyl formamide (DMF) solvent. The polyurethane-impregnated mat is wet-coagulated in a bath of water and DMF. The resulting product is immersed in toluene to extract out the polyethylene, leaving the nylon fibers in a so-called "islands-in-the-sea" base fabric. The base fabric is then coated with polyurethane dissolved in a first solvent and substantially coated with polyurethane dissolved in a different solvent. The resulting synthetic leather is cut into panels and applied as cover material to basketballs and other game balls.

U.S. Pat. Nos. 5,310,178 and 5,669,938 describe the use of synthetic leather of the type described in the Kuraray publications as a cover material for basketballs.

The polyurethane coating of the foregoing synthetic leather is substantially impervious to sweat. As a result, many players prefer to use basketballs which are covered with genuine leather.

SUMMARY OF THE INVENTION

The invention provides a game ball with a synthetic leather cover which maintains softness and grippability in both dry and wet conditions and which has the ability to absorb sweat. The synthetic cover is formed from an islands-in-the-sea base fabric which has a thin top layer of wet-coagulated polyurethane. When the cover material is molded to form the conventional pebbled surface of a basketball, the thin polyurethane coating is ruptured at numerous locations around the sides of the pebbles to form small holes or pores. The small holes on the sides of the pebbles allow sweat to pass through the polyurethane coating and into the interior of the cover.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
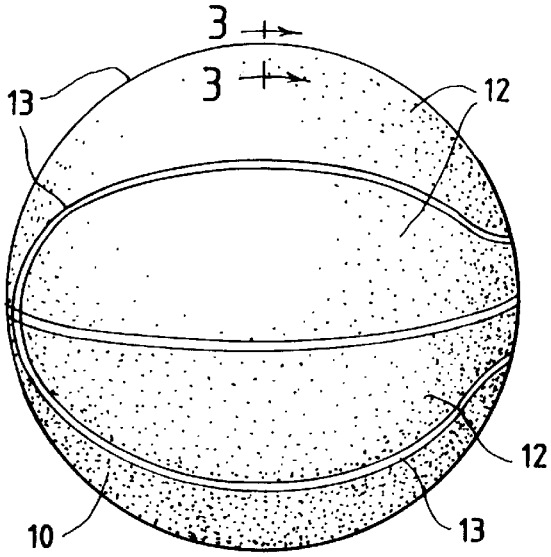
FIG. 1 illustrates a basketball formed in accordance with the invention.

The invention will be explained with reference to a basketball 10 illustrated in FIG. 1. It will be understood, however, that the invention can be used with other inflatable game balls, for example, soccer balls, footballs, and volley balls.

The basketball 10 includes an inflatable bladder 11 (FIG. 3), a plurality of cover panels 12, and rubber seams or channels 13 which separate adjacent cover panels. The particular basketball illustrated is formed in accordance with co-pending U.S. patent application entitled "Inflatable Game Ball with Sponge Rubber Carcass," Ser. No. 08/723,607, filed Oct. 2, 1996, now U.S. Pat. No. 5,681,233, which is incorporated herein by reference.

The bladder 11 may be manufactured in the conventional manner from conventional bladder materials. The bladder is preferably formed primarily of rubber. In the preferred embodiment the bladder was made from 80% butyl rubber and 20% natural rubber.

Figure 2:
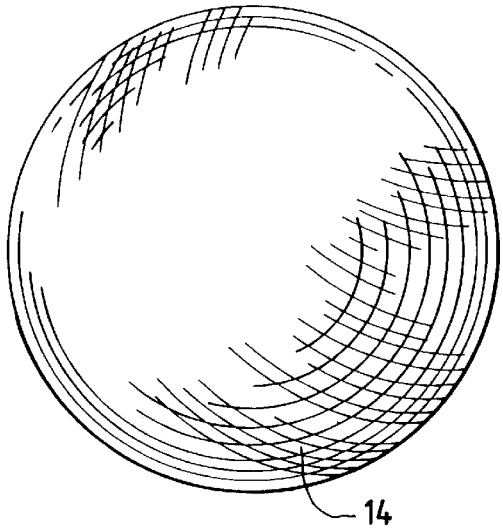
FIG. 2 illustrates a wound bladder before the cover is applied.
Figure 3:
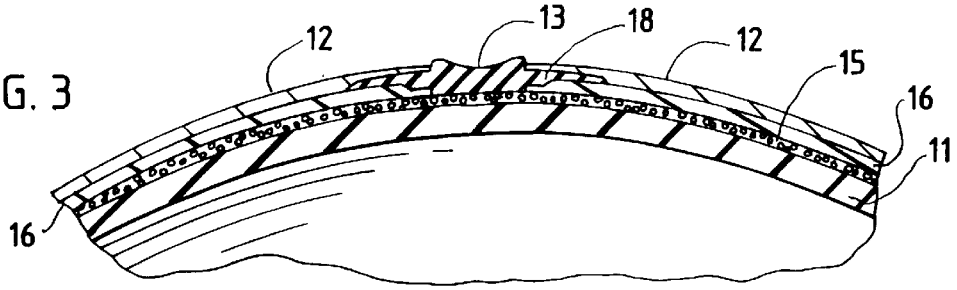
FIG. 3 is a fragmentary sectional view of the basketball.

The bladder is inflated and placed in a vulcanizing or curing mold where the bladder is cured at 160° C. After curing, the inflated bladder is wound with reinforcing thread 14 (FIG. 2) which forms a layer of windings 15 (FIG. 3).

As described in the aforementioned U.S. Pat. No. 5,681,233, the basketball also includes panels of sponge rubber 16 which are applied over the wound bladder and which are separated by the rubber channels 13. Alternatively, the channels 13 could be formed integrally from the sponge rubber 16. The product at this stage of the manufacturing process is called the carcass. The carcass is placed in a sperical mold, and the inflated carcass is heat molded at 160° C.

The cover panels 12 are laid over the carcass between the channels 13 and are secured to the carcass by adhesive and heat bonding.

Figure 4:
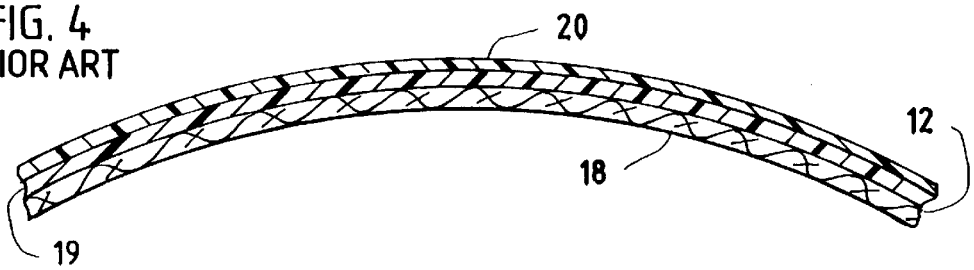
FIG. 4 PRIOR ART
FIG. 4 is an enlarged fragmentary sectional view of a prior art synthetic leather cover material.

FIG. 4 illustrates a prior art synthetic leather cover panel 17 of the type which is described in the aforementioned Kuraray Japanese patent publications. The cover panels include a non-woven base fabric 18 which is impregnated with a solution of polyurethane in DMF. The polyurethane impregnated base fabric is wet-coagulated in an aqueous bath of DMF, and a layer 19 of wet-coagulated polyurethane is formed above the base fabric. The polyurethane impregnated base fabric is immersed in toluene to extract one of the polymers of the base fabric. One or more outer coatings 20 of polyurethane is applied to the layer 19 of wet-coagulated polyurethane.

Figure 5:
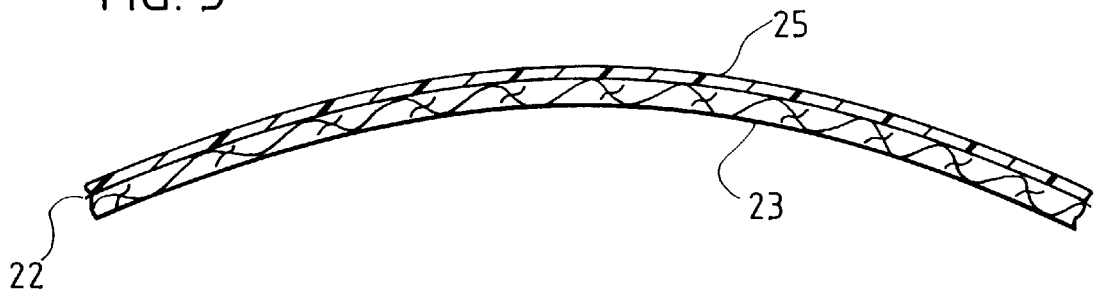
FIG. 5 is an enlarged fragmentary sectional view of the synthetic leather material which is used to form the cover.
Figure 6:
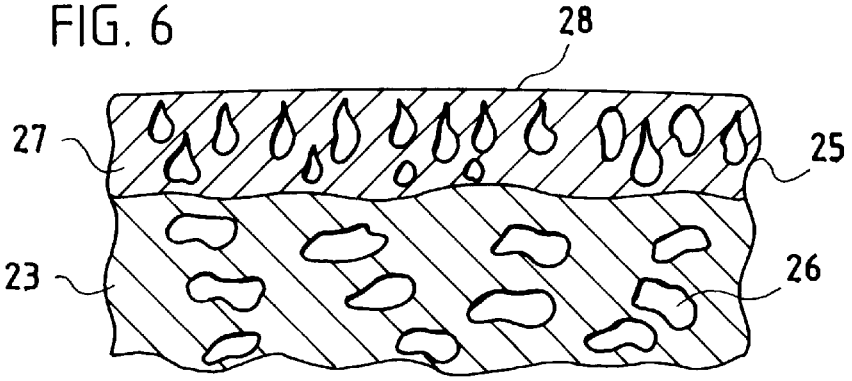
FIG. 6 is a greatly enlarged fragmentary sectional view of the synthetic leather material.

FIGS. 5 and 6 illustrate a sheet of synthetic leather material 22 which is used to make the cover panels 12 in accordance with the invention. The synthetic leather material 22 is made by Teijin substantially in accordance with the Kuraray Japanese patent publications, which are incorporated herein by reference, up to the step of extracting one of the polymers of the base fabric with toluene. The synthetic leather material 22 includes an "islands-in-the-sea" base fabric 23 which is formed of a non-woven polymeric fiber, e.g., nylon, and which is impregnated with wet-coagulated polyurethane. A thin layer 25 of wet-coagulated polyurethane covers the base fabric. The toluene extraction step described in the Japanese patent publications dissolves and extracts the other polymer, e.g., polyethylene, from the base fabric, and leaves voids or spaces 26 (FIG. 6). The nylon fibers can move or flex in the spaces of the base fabric, thereby providing a soft feel.

The synthetic leather 22 is not coated with polyurethane after the wet-coagulating step, and the outer portion of the synthetic leather includes only a thin top layer 25 of wet-coagulated polyurethane.

In the preferred embodiment, the two polymers which are used to make the non-woven base fabric are 0.01 to 0.001 denier nylon fibers and a sea of polyethylene which surrounds the nylon fibers. A denier of 0.01 is equivalent to a fiber diameter of about 1 micron. The polyethylene sea is extracted by toluene. The total thickness of the sheet of synthetic leather material 22 is about 1.6 mm. The thickness of the polyurethane impregnated base fabric 23 is about 1.4 mm, and the thickness of the top layer 25 of polyurethane is about 0.15 mm to about 0.25 mm, preferably about 0.20 mm.

Referring to FIG. 6, the wet-coagulated polyurethane layer 25 which covers the mat of polyurethane-impregnated fibers 23 includes a first portion 27 which is porous or cellular and a thin outer skin 28 which is substantially solid and forms a non-porous outer surface. The pores in the layer 25 are generally teardrop-shaped.

Figure 7:
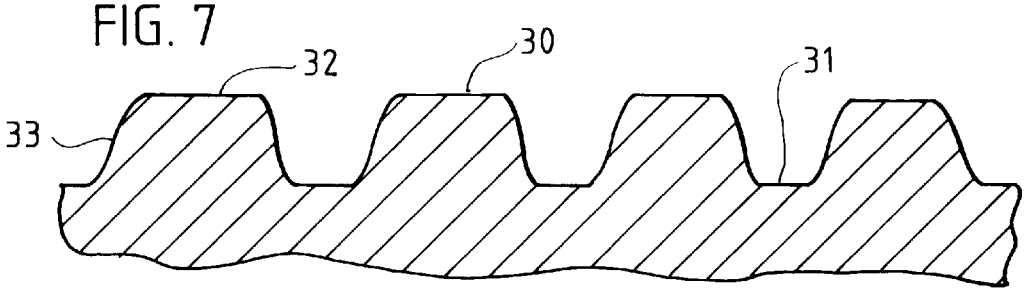
FIG. 7 is an enlarged fragmentary sectional view of the cover material after the pebble configuration is molded into the cover material.
Figure 8:
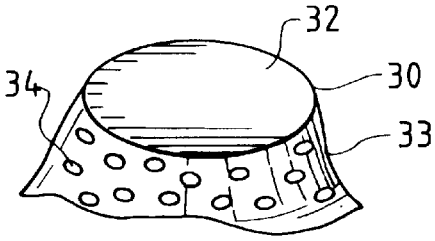
FIG. 8 is an enlarged fragmentary perspective view of one of the pebbles of the cover.

The synthetic leather material 22 is then pressed with a hot embossing roller so that the outer surface thereof is molded into a conventional pebbled surface which includes outwardly projecting pebbles 30 (FIG. 7) which are separated by valleys 31. Each individual pebble includes a generally flat outer surface 32 and a generally frusto-conical side surface 33.

Molding the pebbled surface causes the thin polyurethane layer 25 of the synthetic leather to stretch along the sides 33 of the pebbles, and small holes or pores 34 are formed in the outer skin 28 polyurethane coating. The diameters of the holes are generally within the range of about 0.0007 mm to about 0.001 mm.

It is believed that the polyurethane coating on the outer surfaces 32 of the pebbles does not rupture and remains substantially impervious to moisture. The non-porous polyurethane coating on the outer surfaces of the pebbles therefore provides good durability.

The sheet of synthetic leather 22 is cut into individual cover panels 12 which are glued onto the carcass of the ball. The inflated ball is placed in a mold and heat molded at about 40° C. to bond the cover panels to the carcass.

When sweat comes into contact with the cover panels 12, sweat passes through the holes 34 in the sides of the pebbles and into the spaces in the cellular portion 27 of the polyurethane layer 25. Sweat might also move into the spaces 26 in the base fabric 23 of the cover panels. It is believed that sweat is actually drawn or sucked into the spaces inside of the cover by capillary action.

The basketball 10 retains a soft feel and remains easy to grip even when sweat wets the cover of the ball. The sweat is absorbed by the cover and does not interfere with grippability. After play, the absorbed sweat can evaporate. The basketball therefore has similar or improved playability compared to more expensive leather-covered basketballs.

While in the foregoing specification a detailed description of specific embodiments of the invention were set forth for the purpose of illustration, it will be understood that many of the details herein given can be varied considerably by those skilled in the art without departing from the spirit and scope of the invention.

We claim:

1. A sweat-absorbing inflatable game ball comprising a bladder and a synthetic leather cover, the cover including a base fabric formed of polyurethane-impregnated polymeric fibers and a wet-coagulated polyurethane outer coating above the base fabric, the cover having a pebbled outer surface provided by a plurality of outwardly projecting pebbles and valleys between the pebbles, each of the pebbles having a side surface and an outer surface, the polyurethane outer coating of the cover having a plurality of openings on the side surfaces of the pebbles.

2. The game ball of claim 1 in which the polyurethane outer coating above the base fabric has a thickness of about 0.15 mm to about 0.25 mm.

3. The game ball of claim 1 in which the size of the openings is within the range of about 0.0007 mm to about 0.001 mm.

4. The game ball of claim 1 in which the outer surfaces of the pebbles are substantially impervious to sweat.

* * * * *